US010728667B2

(12) United States Patent
Poholek

(10) Patent No.: US 10,728,667 B2
(45) Date of Patent: Jul. 28, 2020

(54) ACTIVE CHANNEL CROSSOVER SYSTEM

(71) Applicant: Ernest Michael Poholek, North Attleborough, MA (US)

(72) Inventor: Ernest Michael Poholek, North Attleborough, MA (US)

( * ) Notice: Subject to any disclaimer, the term of this patent is extended or adjusted under 35 U.S.C. 154(b) by 0 days.

(21) Appl. No.: 16/658,050

(22) Filed: Oct. 19, 2019

(65) Prior Publication Data

US 2020/0128327 A1 Apr. 23, 2020

Related U.S. Application Data

(60) Provisional application No. 62/765,962, filed on Oct. 19, 2018.

(51) Int. Cl.

| | |
|---|---|
| ***H04R 3/14*** | (2006.01) |
| ***H04S 3/00*** | (2006.01) |
| ***H04S 7/00*** | (2006.01) |

(52) U.S. Cl.

CPC ..... *H04R 3/14* (2013.01); *H04S 3/008* (2013.01); *H04S 7/30* (2013.01); *H04S 2400/01* (2013.01); *H04S 2400/13* (2013.01)

(58) Field of Classification Search

None

See application file for complete search history.

(56) References Cited

U.S. PATENT DOCUMENTS

| | | | | |
|---|---|---|---|---|
| 5,450,494 A * | 9/1995 | Okubo | ..... | H03G 3/32 348/E5.122 |
| 2016/0171985 A1* | 6/2016 | Reams | ..... | H04N 5/52 381/99 |
| 2018/0192229 A1* | 7/2018 | Easley | ..... | H04R 3/14 |

* cited by examiner

*Primary Examiner* — Paul W Huber

(57) ABSTRACT

The contained Pass And Limit Modulator removes approximately 50% common or in phase information from two inputs as compared to summing both inputs. This output can be used in a whole building music system or in a mono amplitude modulated radio transmission down-mixed from stereo audio content. The center channel (dialogue) is lowered 50% as not to overpower the music. With the Active Channel Crossover System the center channel is further processed and mixed to obtain multiple output channels. Interactive left and right channel frequency decomposition of a stereo signal is performed for optimum reproduction of a down converted front center channel. This way channel removal speed is respective to the frequencies removed. Further processing reduces the interactive left and right channel frequency decomposed content within the center channel output. As a result, the down-mixed front center channel is reproduced more closely as intended to be heard in its original stereo form. Further processing within the Active Channel Crossover System produces a balanced multi channel music system.

1 Claim, 11 Drawing Sheets

ACTIVE CHANNEL CROSSOVER SYSTEM

CROSS-REFERENCE TO RELATED APPLICATIONS

This application claims the benefit of PPA No. 62/765,962 by the present inventor, which is incorporated by reference.

BACKGROUND

Field

This invention relates to the field of signal reproduction for processing stereo or two audio inputs into one or more reproducing source.

Other Publications

"Dolby Surround Pro Logic Decoder Principles Of Operation" by Roger Dressler section 2.5, and 2.7

PRIOR ART

Dolby Pro Logic®, Dolby Pro Logic II® and Dolby Digital® are registered trademarks of Dolby Laboratories.

DISCUSSION OF PRIOR ART

There are numerous spectral band mapping or spectral matrix audio signal processors. These processors decode by breaking down a signal into a set of spectral bands using a spectral decomposition algorithm, directing the input signals in each of the bands from each of the input channels to corresponding bands of each of the output channels as directed by spectral mapping coefficients with logarithmic methods for obtaining a spectral matrix surround system. These types of audio signal processors are effective but they involve many stages of processing and complexity adding to cost making this expensive for the average person to purchase.

Many other multi-channel audio conversion systems, methods, and circuits have been improvised to down-mix stereo into separate channels, which provide an enhanced sound field. This process involves determining channel dominance which may include channel difference and using this information for determining each output channel. Typical processes of prior art may include network delays, digital processing circuitry, demultiplexers, compression, and/or expansion, individual channel voltage controlled amplifiers for volume correction of each channel, multiple rectifiers, logarithmic amplifiers, log ratio processing, multiple phase shift networks, network delays for the front left, front right and rear channels, numerous matrix elements, a speech filter for the downloaded front center channel, many band pass or high and or low pass filter stages for interactive gain-controlled detection, equalizers equalizing output levels, microprocessors executing software instruction, D-A converters, specialized integrated circuits, and large parts count, whereas the current invention has a novel processing method using only one VCA, to control the mix of all front channels with a low parts count. The simplest prior art method to simulate a S. C. channel output use summed S. L.+S. C.+S. R.+S. C. or mono (see Definitions). Others use additional logic, amplitude control, channel steering and methods previously described.

Definitions, Figure References and Abbreviations

Provided below is a list of conventional terms and equipment used to test and verify measured data obtained from this new art. For each of the terms below a definition is provided in accordance with each of the term's conventional meaning in the art. The terms provided below are known in the art and the following definitions are provided for convenience purposes. Accordingly, unless stated otherwise, the definitions below shall not be binding and the following terms should be construed in accordance with their usual and acceptable meaning in the art. Some terms and abbreviations have been modified to represent this new art. Abbreviations have been added to point out the areas of waveforms to enhance understanding the down-mix process of this invention.

The difficulty in measuring channel separation speed under various conditions is resolved by the complex waveform generator 115, shown in FIGS. 5, 6, and 6A. This test equipment is explained to visualize the waveform displays clearly. Each of three internal generators simulates one of the following stereo channels comprised of front left, front center and front right channels, with control circuitry switching abruptly to separate or join each internal oscillator to simulate stereo with three output channels. A continual center channel summed with the test waveform outputs can be switched on or off to measure combined channel content separation speed. Visual interpretation is simplified by switched internal triggering controls synchronizing the three internal generators to harmonics of one generator. User adjustment controls and internal functions are:

- Simultaneous control of stereo left, center and right channel's output amplitude levels;
- frequency and amplitude controls for each individual channel;
- functions for internal and external trigger input and output synchronization;
- variable passing or removing sequence of individual center, left and right channels;
- interval of passing and removing rate of three channels.

The complex waveform generator provides outputs for inputting into a device under test with connections for display on a dual channel oscilloscope or other test equipment which is used to visualize a the waveforms for measuring channel separation speed. Any duplication of this type of complex waveform generator may be arranged with the author.

Waveform measurements were taken at waveform measurement test points and are referenced by the lower case alphabetic designator "a" or "b" added to the numeric designator in FIGS. 5, 6, and 6A. In FIGS. 3, 3A, 3B, 4, and 4A the respective numeric designator with the same added alphabetic indicator indicate the displayed waveforms. The numeric designators in FIGS. 1, 2, and 2A indicate reference points where the waveform measurements were obtained.

Electronic abbreviations:

pf=pico farads;

uf=micro farads;

The abbreviations and terms listed below are to be construed according to the following definitions shown in this patent submission.

S. L.:

is the up-mixed stereo left channel information shown in FIG. 3 and FIG. 4.

S. R.:

is the up-mixed stereo right channel information shown in FIG. 3 and FIG. 4.

S. C.:

is the up-mixed stereo center channel information shown in FIG. 3 and FIG. 4.

Lm:
is the down-mixed left channel output content from a Pass And Limit Modulator shown in FIG. 3A.

Rm:
is the down-mixed right channel output content from the Pass And Limit Modulator output shown in FIG. 3A.

Cm:
is the down-mixed center channel content from the Pass And Limit Modulator output shown in FIG. 3A.

Lt:
is the up-mixed stereo left and center channel information shown in FIG. 3 or FIG. 4.

Rt:
is the up-mixed stereo right and center channel information shown in FIG. 3 or FIG. 4.

Lt+Rt:
shown in FIG. 4A is the down-mixed stereo component information obtained by summing Lt and Rt shown in FIG. 4.

Cdn:
shown in FIG. 3B and FIG. 4A are the preliminary front center channel down-mixed channel information with reduced channel information of Lfr and Rfr obtained by down-mixing Lt and Rt shown in FIG. 3 and FIG. 4.

Cf:
is the down-mixed stereo preliminary front center component information shown in FIG. 3B and FIG. 4A.

Lfr and Rfr:
are the down-mixed front left and front right residual stereo component information transferred into preliminary front center channel processing shown in FIG. 3B and FIG. 4A.

Waveform display:
is a computer simulated waveform display for visual representation and analysis. These are displays of electronically synthesized inputs and processed output of prior art and this new art to assist as visual explanation of their function.

Pass And Limit Modulator:
105 (FIG. 1). The control circuit for passing in phase information without summing obtained from two up mixed inputs; the same two up-mixed inputs containing the not in phase information is modulated by difference limiting.

Difference limiting:
is the process utilizing the Pass And Limit Modulator of two inputted signals which interact and are composed of in-phase signals and mixed phase signals, in which the mixed phase signals modulate each other by the amount of phase difference. For example: a greater phase difference between the two input signals causes more of the phase signals to be cross modulated. Conversively, the less phase difference between the mixed phase signals causes less of the mixed phase signals to be cross modulated. When the phase difference is zero degrees, all the in phase information passes but is not summed.

Active Channel Crossover System:
(FIG. 2A) A method utilizing the Pass And Limit Modulator output to obtain multi channel outputs.

Ring down:
is related to fall time, ringing, damping and frequency decomposition. In this new art, ring down frequency components occur when transitioning from in phase frequency content into frequency content which has not in phase or different information contained in one or both inputs.

Sine Wave:
one of many sinusoidal waveform outputs: Left Input 101*a* and Right Input 102*a*, or Left Input 101*b* and Right Input 102*b*, respectfully shown in FIGS. 3 and 4, created by the complex waveform generator 115 in FIGS. 5, 6, and 6A.

Oscilloscope:
an electronic instrument capable of displaying a visual representation in a graphical display created by the complex waveform generator. A dual channel oscilloscope computer program is used for measurement reproduction of these up mixed waveform displays shown in FIG. 3 and FIG. 4. The down-mixed waveform displays are shown in FIGS. 3A, 3B and 4A. The Oscilloscope or visual capture display device is not shown in any of the diagrams.

Up-mixing:
the process of converting multiple sound sources into combined channels as in stereo.

Down-mixing:
the process of converting a stereo signal with in phase and not in phase signals into separate channels.

Modulation:
The effect in which channel information from one channel amplitude modulates the down-mixed opposing channel.

Phantom Image or Phantom Sound:
The virtual sound-source generated in reproduction of stereo sound via two transducers or loudspeakers. The phantom image may be located in front equidistant from the two speakers, to the sides of the front speakers or behind the listener. The center channel phantom image reproduced with speakers is the most perceived but is only imagined, and is not as distinct as if the original source center channel is reproduced by a speaker. The Phantom Sound is also perceived when wearing headphones as a third sound source centrally located between both eardrums in within a persons head.

Sherwood RD-6500 audio/video receiver (Sherwood America: A manufacturer of hi-fi equipment including AV receivers. Presently owned by Inkel in South Korea containing a Dolby Pro Logic II® Decoder) is positioned in the Pro-Logic mode using the auxiliary inputs on the receiver which is used for the prior art Cdn (front center) down-mix test in FIG. 5 with the output 400*a*. The waveform display is shown as 400*a* in FIG. 3B.

Advantages-FIG. 1, 2, 2A, 3 and FIG. 4

This new art Active Channel Crossover System is used for optimizing a sound field produced for an individual or a plurality of listeners in a listening environment. The preliminary processing unit is the Pass And Limit Modulator in FIG. 1, 105 which contains 18 components, no logarithmic amplifiers, no complex digital circuitry to obtain reduced in phase information shared by two inputted signal sources. Only three additional resistors 109 shown in FIG. 2 complete the down-mix to obtain an immediate response to obtain a Preliminary Center Channel Output 118 which is used as a primary source of down-mix processing. With further processing shown in FIG. 2A, parts count is minimized by using one filtered L-R rectified control signal to control one VCA which controls the signal mixture for all forward facing down-mixed channels, whereas most down-mix systems use one VCA for each output channel.

A recording studio up-mix may modify stereo content by remixing the sound tracks to compensate for non-linear microphone inputs, nonlinear speaker reproduction, odd sounding shared channel modulation or remove higher frequency components within the center channel to prevent mixed modulation effects of the of the left and right channels in the stereo up-mix process. The advantage of this new art is a capability to restore these de-emphasized frequencies with a high frequency enhancement to the center channel with a high frequency boost circuit 126 shown in FIG. 2A. The high frequencies are restored with reduced left and right information. The front center channel sub woofer output 133 also contains reduced left or right channel low frequency information.

Many prior art methods down-mix separate channel information within 100 milliseconds after channel dominance is determined. As the frequencies get higher in the S. L. and/or S. R. channels FIGS. 3, and 4, this channel separation time causes less removal of the S. L. and/or S. R. channels from the down-mixed Cdn channel. As a result, most frequencies from the S. L. or S. R. channels will not be removed fast enough from the Cdn channel immediately after each part of the dominant cycles are determined non dominant. Ideally each frequency of the S. L. or S. R. channels should be removed from the Cdn channel in proportion to the S. L. or S. R. channels frequencies and channel dominance state. This results in removing a major part of the frequency cycles of the up-mixed S. L. or S. R. channels from the Cdn channel. As higher frequencies are processed, down-mix channel separation speed responds faster than at lower frequencies to remove that proportional cycle of higher frequency content from the S. L. or S. R. channels reproduced in the Cdn channel. Using this process the stereo center channel signal is minimally altered by the down conversion and is reproduced closely to its original stereo form. Slower volume correction circuitry adds to a delayed removal of original left or right channel information. Unfortunately, most prior art redirecting methods are limited by their down-mixed channel separation delay times, complicated algorithms or both. For an optimum down-mix process, many factors have to be considered and add to the complexity of any multi-channel down-mix converter.

SUMMARY

The Active Channel Crossover System central processing or analog function is to pass in phase content of two input signals without summing the two. This new art invention utilizes a novel electronic method to determine, separate and down convert into the front center channel output, front left, front right and front sub-woofer outputs. It is the main purpose of this invention to provide an effective simple low cost and low parts count method for converting two input sources containing stereo or multi channel information, into a usable source of down-mixed single channel or multi-channel reproduction.

DISCLOSURE OF THE INVENTION

It is an object of the present invention to provide a signal obtained from two inputs with mixed non identical and identical content for use with down-mixing multi-channel audio synthesis, or, difference cancellation and identical information passing of two input signal sources.

Operation is based on the following: Processing two inputs through current limiting elements producing a reduced signal of limited in phase content. This continued process functions by limiting dissimilar content, passing identical information or passing any of the inputs when only one inputs is active. Enhanced multi-channel outputs are formed using using the source of this process which separates the stereo signal into four or more different channels. Similarities between the front left, front right and front center channels are reduced for distinct source definition.

DESCRIPTION

Figure 1:
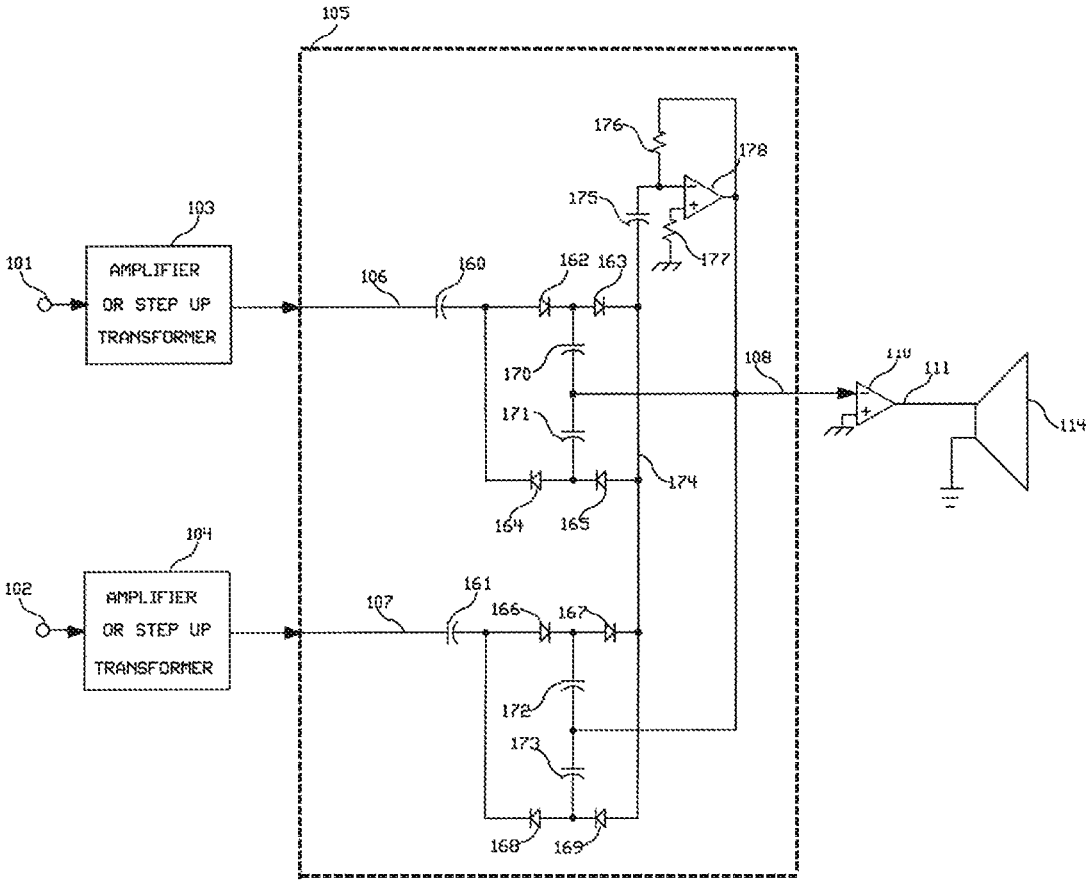
FIG. 1 is a schematic of an arrangement to obtain a down-mix signal of of the first embodiment.
Figure 3:
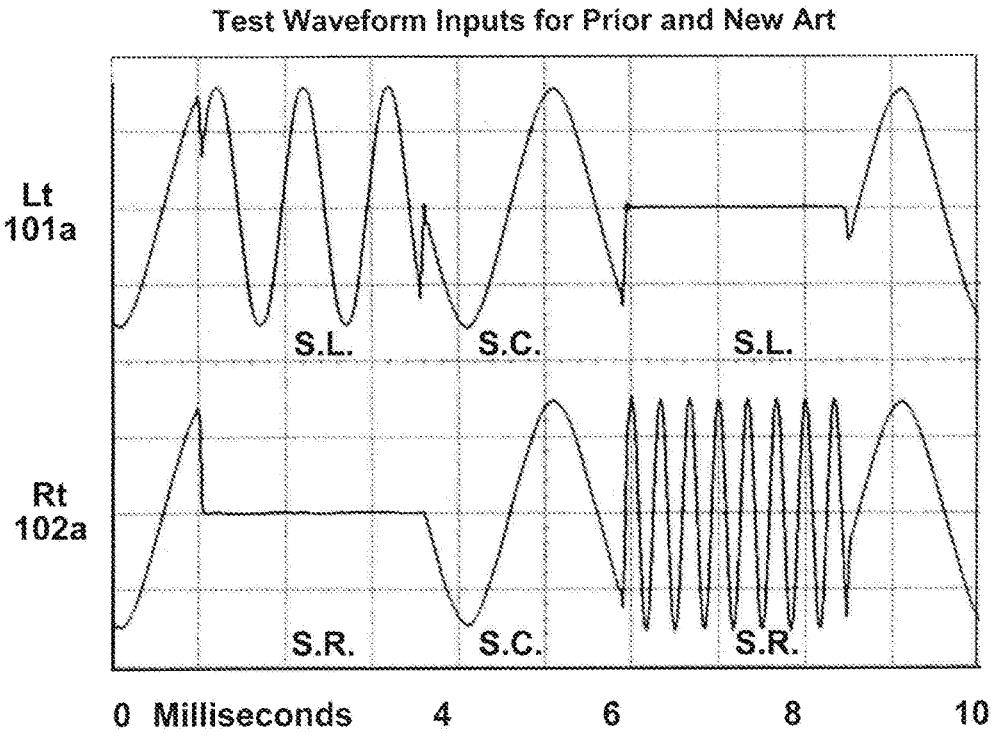
FIG. 3 displays generated up-mixed test waveforms outputs simulating stereo for analysis and comparison of prior and new art down-mix operations.
Figure 3A:
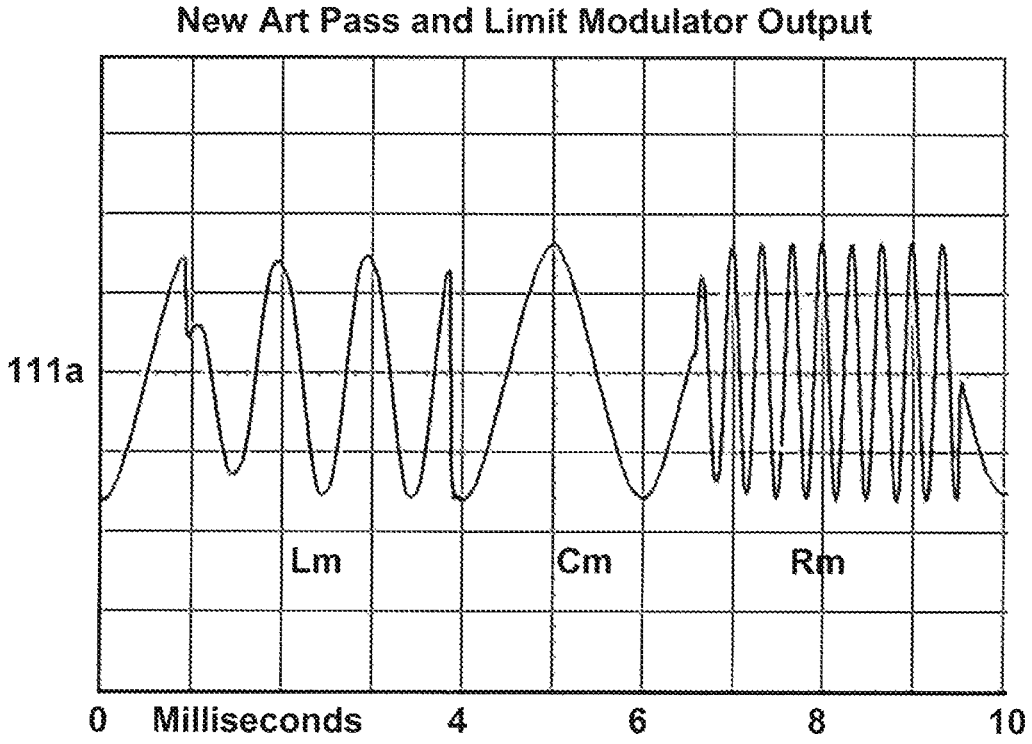
FIG. 3A displays the down-mixed combined waveforms of Lm and Rm, with reduced S. C. channel information indicated as Cm (see Definitions) outputted from this new art.

First Embodiment FIGS. 1, 3, and 3A

These and objects will be readily apparent to persons of ordinary skill in electronics through the detailed description of the invention with the accompanying schematics, diagrams and waveforms.

The first embodiment in FIG. 1 is shown with two outputs: The first output 108 has inverted audio content with 50% reduced center channel in phase information, this is amplified by amplifier 110 which produces in-phase output 111. Speaker 114 reproduces 111 content with the reduced by 50% center channel voice or in-phase information of a down-conversion from stereo into mono. This output equalizes levels of music and voice for use in an A.M. amplitude modulated radio station studio, where stereo is down-mixed into a mono broadcast. A second use for this output is for monophonic background music on a public address system or intercom.

Figure 2:
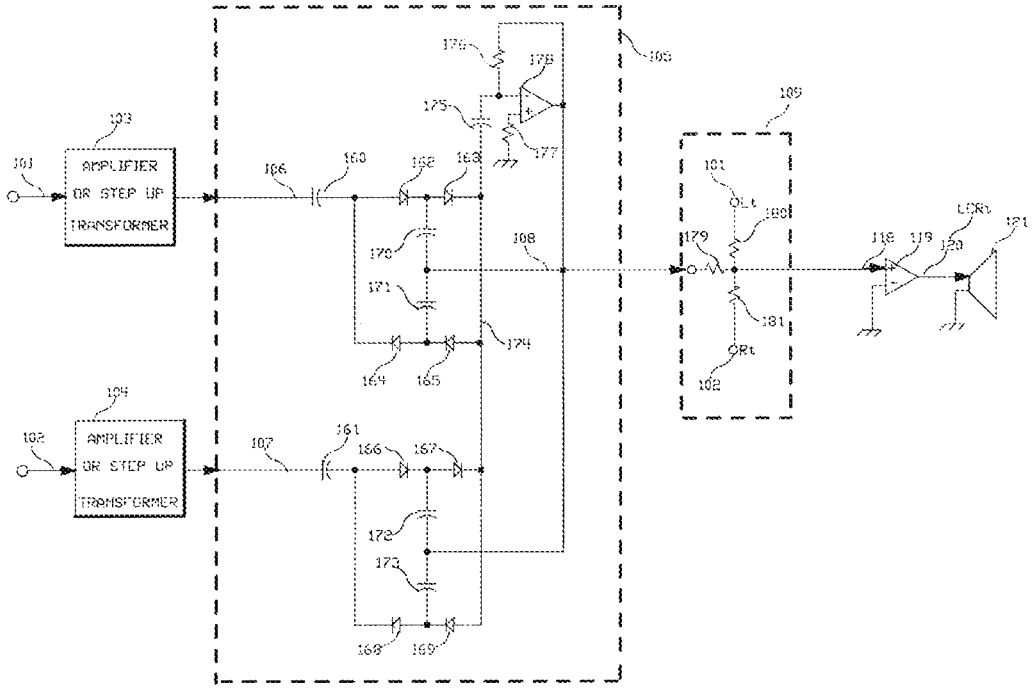
FIG. 2 is a schematic diagram of the components to obtain the second down mix signal of the second embodiment.

Second Embodiment FIG. 2

The second embodiment is using the process within the Active Channel Crossover System which converts output 108 into a preliminary front center channel 120. Shown as 108 inputted into resistor divider 109 containing 179, 180 and 181, producing output 118 amplified by 119 producing output 120, reproduced by speaker 121. This is the simplest way to enhance a stereo system by the addition of one speaker equidistant between the forward facing stereo speakers. The advantage of this is it decreases individual left or right channel information within the centrally placed speaker in approximately two cycles of the frequency of the left or right channels.

Figure 2A:
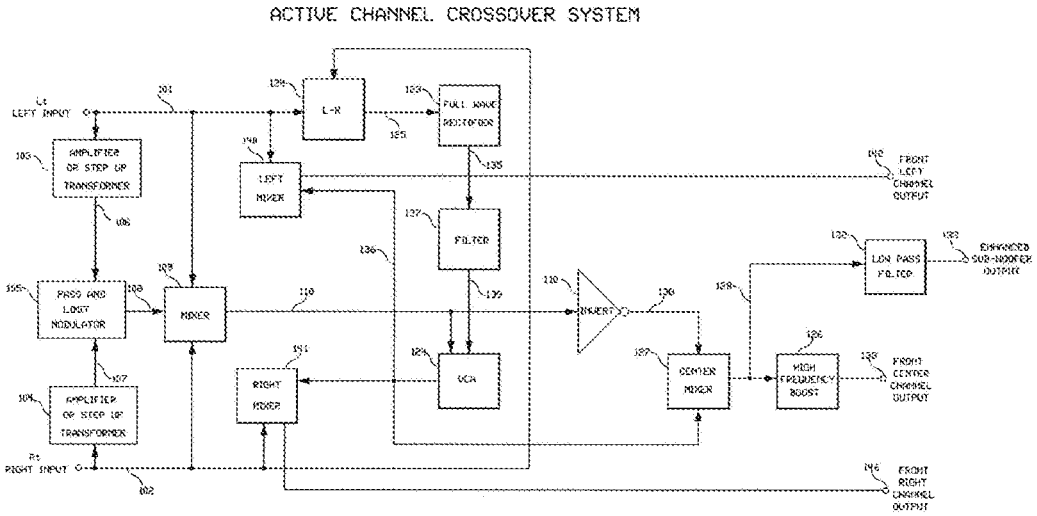
FIG. 2A is a block diagram showing a third embodiment of the new art stereo down-conversion into a 4 channel system.

Third Embodiment FIG. 2A

The third embodiment is using the process within the Active Channel Crossover System which converts output 108 into a front center channel 120, front center sub-woofer 133, front left 142 and front right 146, sound source. This is used to create an enhanced multi-channel sound system converting stereo into a front center, front left, front right, and front sub-woofer.

Additional Embodiment—FIG. 2A

The Active Channel Crossover System may be used for interference cancellation of two input signal sources for wind noise reduction for use with microphones from two microphone elements with a baffle positioned between the elements to change the phase or intensity of the wind from striking each microphone element identically. The audio vibration sensing pickup portion of each microphone is facing the person using the microphone. Most wind travels in a horizontal direction therefore the wind noise coming vertically from the direction of the sound source is less likely. Microphone output one is connected to Lt and microphone output two is connected to Rt inputs of the Active Channel Crossover System shown in FIG. 2A and is processed into a Preliminary Center Channel Output 118, or for enhanced wind rejection is further processed into outputs 128 or 138.

Figure 6:
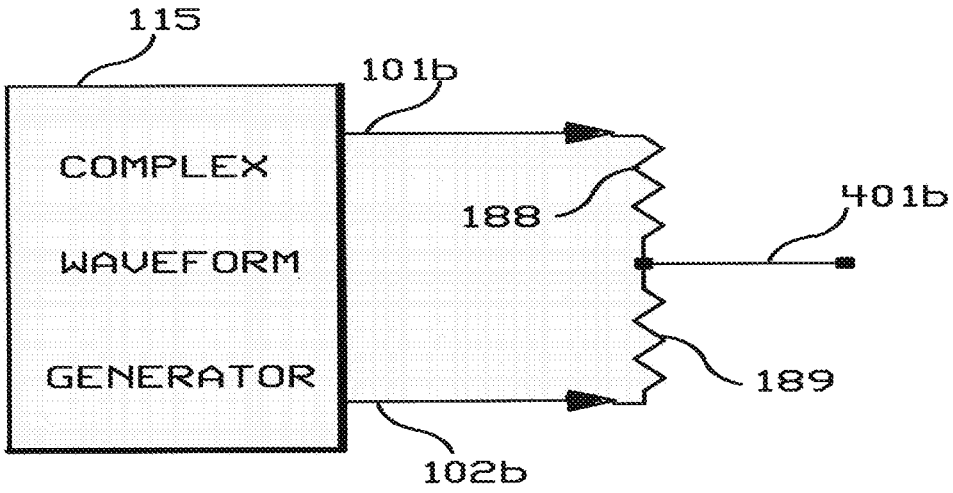
FIG. 6 is a testing method using the complex waveform generator output simulating stereo for analysis and comparison of a basic prior art summing method.
Figure 6A:
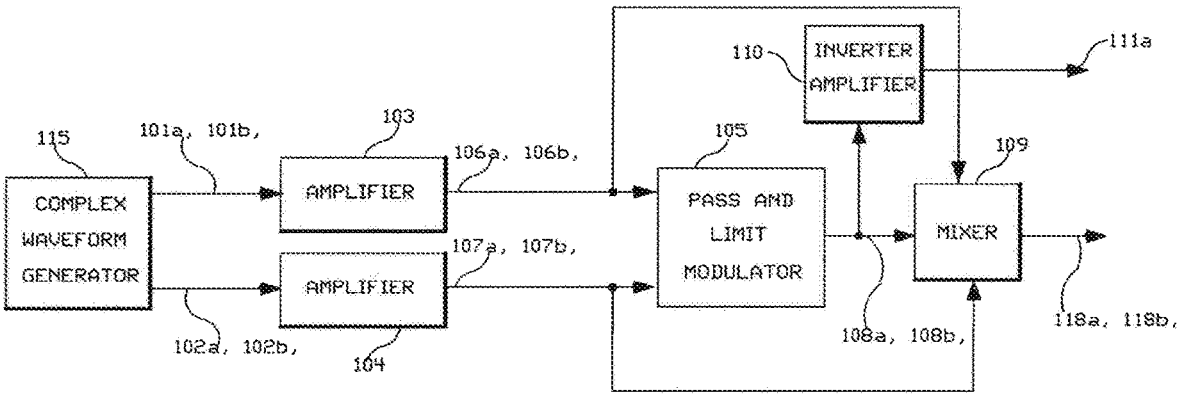
FIG. 6A is a testing method using the complex waveform generator output simulating stereo for analysis of new art down-mixed functions.

First Waveform Test—FIGS. 3, 3A, 3B, 5, 6A,

In order to visualize the advantages of this invention, a testing method using the complex waveform generator produces uploaded waveforms as inputs to compare downloaded results of prior art and new art. These and objects will be readily apparent to persons of ordinary skill in electronics through the detailed description of the invention testing methods with waveform references to the accompanying diagrams and schematics in which:

The waveforms in FIG. 3, Left Input 101*a* and Right Input 102*a* are up-mixed output waveforms of the complex waveform generator 115 shown in FIG. 6A. The up-mixed waveform timing displays shown in FIG. 3 is 10 milliseconds for full horizontal display or 1 millisecond for each horizontal to vertical line junction. Sine waves are used for visual diagnostic data to simplify explanations. The displayed up-mixed waveforms (viewed left to right) are: Left Input 101*a* (S. L.=1000 cps, S. C.=500 cps, S. L.=no signal; and Right Input 102*a* (S. R.=no signal, S. C.=500 cps, S. R.=3000 cps). These waveforms are amplified by 103 and 104 in FIG. 6A into outputs 106*a* and 107*a* respectively which are processed by the Pass and Limit Modulator 105 into the down-mix output 108*a* which is inverted by inverter 110 into 111*a*, the waveform is shown in 111*a*, FIG. 3A. This shows the down-mixed processed output 111*a* (Lm+Cm+Rm) indicating an output of reduced center channel (Cm) with summed Lm and Rm channel information. Notice the down-mixed Cm level is not doubled or summed but reduced by half in comparison to summing. This output reduces the overpowering center channel voice or in-phase information of a down-conversion from stereo into mono. In FIG. 6A the down-mixed new art output 108*a* is mixed in mixer 109 producing Preliminary Center Channel Output 118*a* shown as waveform 118*a* in FIG. 3B.

Figure 5:
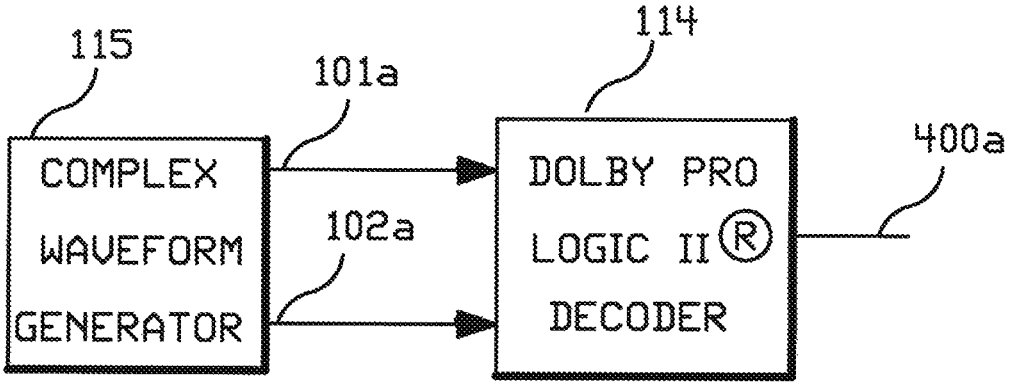
FIG. 5 is a testing method using the complex waveform generator output simulating stereo for analysis of a prior art Dolby Pro-Logic II® Decoder.

The waveforms in FIG. 3: the Left Input 101*a* and Right Input 102*a* are the same up-mixed output waveforms of the complex waveform generator shown in FIG. 5. These are down-mixed by a Dolby Pro-Logic II® decoder 114 into prior art output 400*a* which is shown as the waveform 400*a* in FIG. 3B.

The prior art Dolby Pro-Logic II® decoder test in FIG. 5 is compared to the new art test shown in FIG. 6A. Observe the waveforms in FIG. 3B and compare the waveforms of new art Preliminary Center Channel Output Cdn 118*a* to prior art output 400*a*. Notice the new art 118*a* fast ring-down (Lfr) or removal of Lf 1000 cps frequency within approximately 1.5 milliseconds and faster removal of Rf 3000 cps frequency shown as Rfr within approximately 0.5 milliseconds with approximately 5% of Rf remaining. This shows a channel separation speed of over 100 times faster than the prior art Dolby Pro-Logic II® 400*a* comparison. The New Art processing of the Lf and Rf frequencies are down converted at a speed related to the frequencies being removed from the center Cdn channel output.

Second Waveform Test—FIGS. 3B, 4, 4A, 6, 6A

A description of the invention testing methods with waveform references to the accompanying diagrams and schematics are shown.

Figure 4:
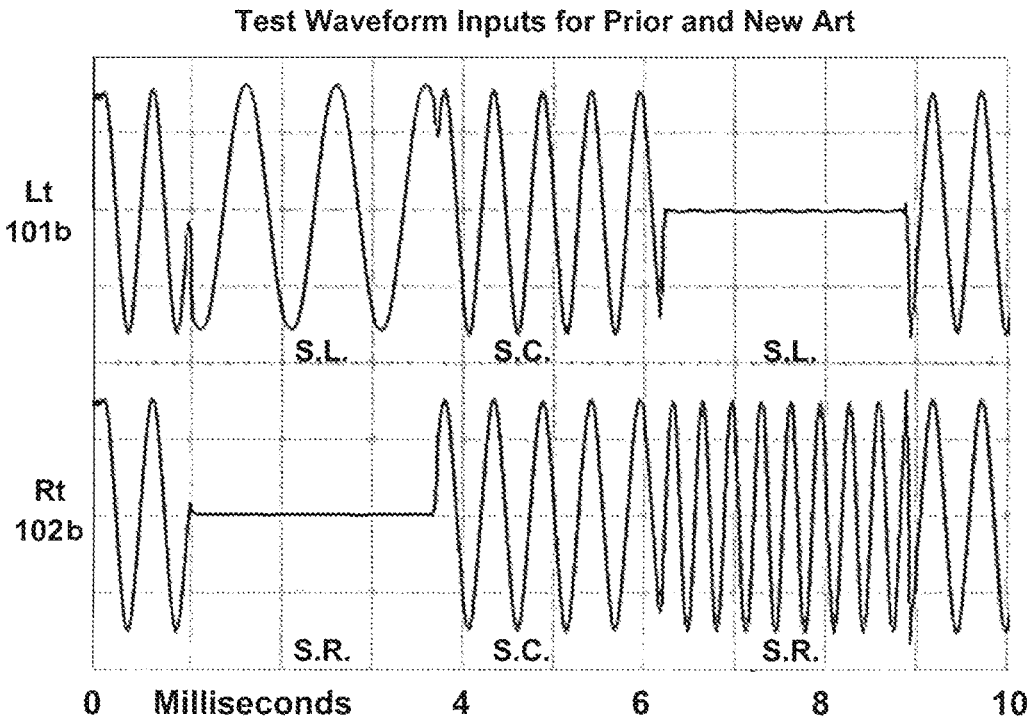
FIG. 4 displays up-mixed test waveform outputs used for simulating stereo for visual interpretation and comparison of prior and new art down-mixes.

The waveforms in FIG. 4, Left Input 101*b* and Right Input 102*b* are up-mixed output waveforms of the complex waveform generator 115 shown in FIG. 6A. In FIG. 4 the up-mixed waveform timing displays shown in each figure are 10 milliseconds for full horizontal display or 1 millisecond for each horizontal to vertical line junction. Sine waves are used for visual diagnostic data to simplify explanations. The displayed up-mixed Lt inputs are shown left to right as: S. L. channel input 101*b* with a frequency of 1,000 cps; followed by S. C. channel input with a frequency of 2000 cps; followed by a no signal or no input. The displayed up-mixed Rt inputs left to right are shown as: S. R. channel input 102*b*, a no signal or no input; followed by S. C. channel with a frequency of 2000 cps; followed by S. R. channel with a frequency of 3,000 cps. In FIG. 6A these waveforms are amplified by 103 and 104 into outputs 106*b* and 107*b* respectively which are processed by the Pass and Limit Modulator 105 into the down-mix output 108*b* which is mixed in mixer 109 producing Preliminary Center Channel Output 118*b* shown as waveform 118*b* in FIG. 4A.

The waveforms in FIG. 4, Left Input 101*b* and Right Input 102*b* are the same up-mixed output waveforms of the complex waveform generator shown in FIG. 6A. These are down-mixed or summed by resistors 188 and 189 as prior art into output 401*b* (Lt+Rt) shown as waveform 401*b* in FIG. 4A.

Figure 3B:
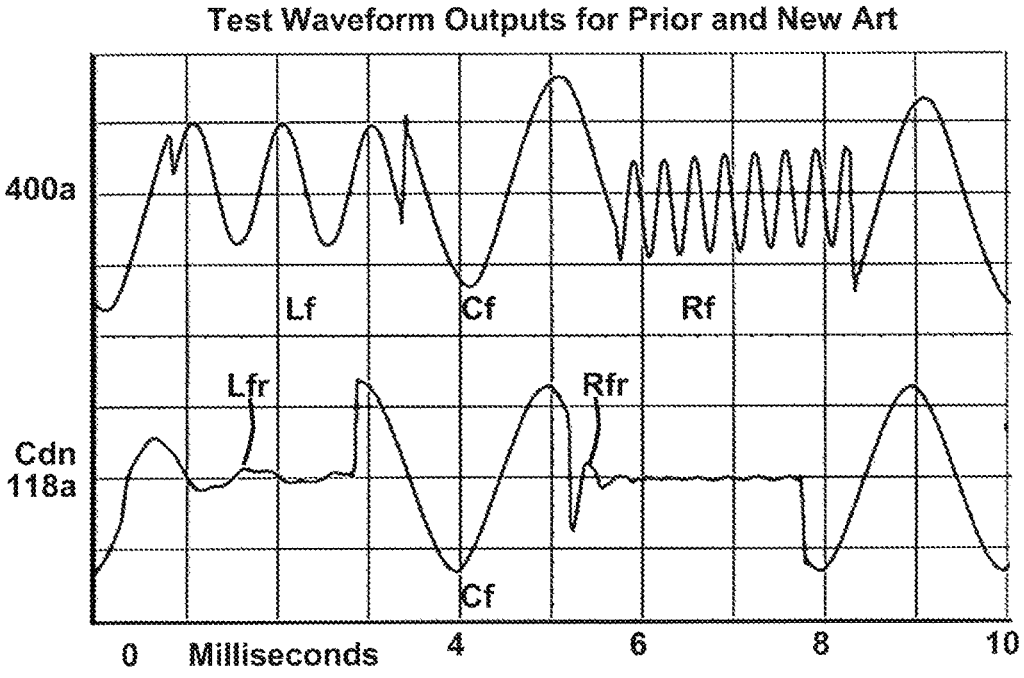
FIG. 3B displays the down-mixed front center channel waveform outputs of prior art Dolby Pro-logic II® and preliminary front center channel output from new art for comparison.
Figure 4A:
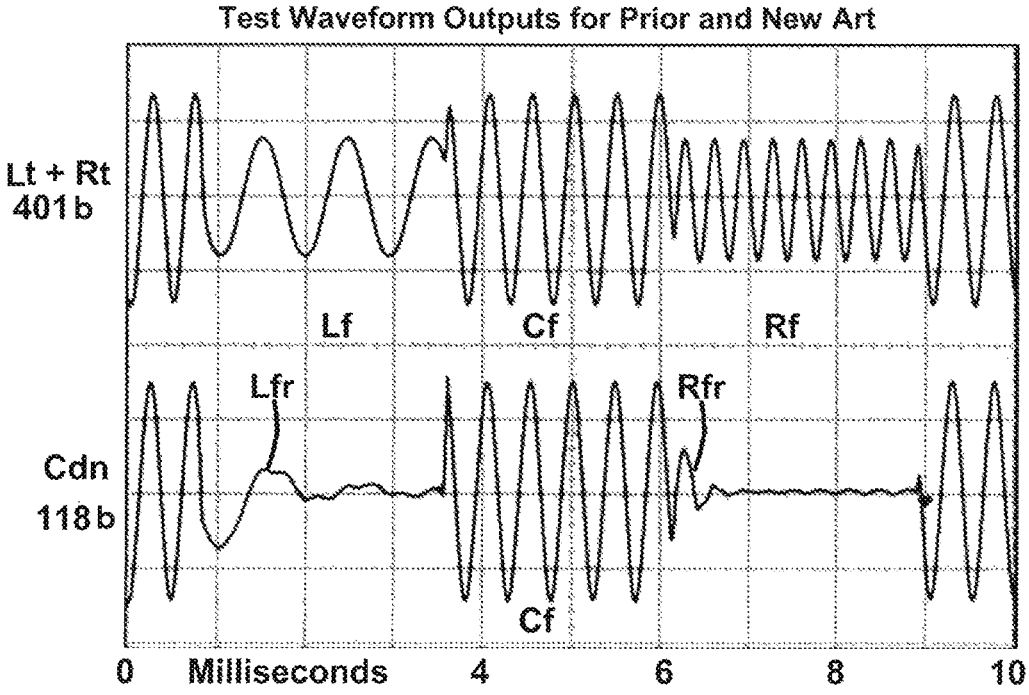
FIG. 4A displays down-mixed waveform outputs by summing and new art.

In FIG. 4A observe the new art down-mixed waveform Cdn 118*b* with diminishing Lfr and Rfr of the inputted S. L. and S. R. channels shown in FIG. 4. The Lfr and Rfr indicators in FIG. 4A show the reduction process for comparison to Lf and Rf of summed waveform 401*b*. The Rfr removal processing to less than 5% remaining of Rf is approximately 3 times faster than the S. L. channel removal from the Cdn 118*b* channel content. This shows the new art frequency adaptability for removal speed of the Lf and Rf channels dependent upon S. L. and S. R. input frequencies shown from FIG. 4. This is the unique channel separation adaptability of this new art process which adjusts channel separation in accordance to frequency input of the S. L. and S. R. channels. Refer back to FIG. 3B and compare prior art Dolby Pro-logic II® waveform down-mix output 400*a* to FIG. 4A of conventionally summed waveform 401*b* and notice there isn't much difference between the channel separation. In FIG. 3B the slow decaying waveform of the Lf and Rf shown within the waveform of 400*a* of the Dolby Pro-logic II® set in the fast mode does not respond fast with these amplitude differences and channel switching rates to remove Lf and Rf from the center channel output. Therefore, in this prior art, frequencies above 100 cycles per second in either or both of the S. L. or S. R. up-mixed channels in FIG. 3 occurring within 100 milliseconds of S. C. up-mix channel occurrence are mostly down-mixed into the center channel output as 400*a*.

Operation-FIGS. 1, 2, 3A, 3B, 6A

In the accompanying schematics, when part numbers or values of components indicated are altered, this will effect channel separation, introduce signal clipping, change current required to operate, heat sinking and/or frequency response.

The Pass And Limit Modulator 105 components are shown as schematic/diagram in FIG. 1 and FIG. 2. Left Input 101 and Right Input 102, of zero to approximately 4V P-P are amplified by amplifiers or step-up transformers 103 and 104 which raise voltage levels into 106 and 107 for a maximum of approximately 300V P-P. Other component values of the Pass And Limit Modulator are possible by changing the maximum input levels of 106 and 107. The voltage amplifiers 103 and 104 in FIG. 1 and FIG. 2 are capable of outputting 300V P-P as inputs 106 and 107. The voltage rating of input capacitors 160 and 161 in FIG. 1 or FIG. 2 should be low leakage type rated for at least at 500 volts D.C., or less if lower voltages are applied. As varying signals and levels are applied, the capacitive reactance and resistance of diodes 162, 164, 166, and 168 change within the two modified bridges created by the signals within each bridge. This variable capacitive reactance interacts with the input capacitors 160 and 161 which serve as current limiters and isolation for the voltage sources 106 and 107. Diodes 163, and 167, pass positive polarities; diodes 165 and 169 pass negative polarities. Capacitors 170, 171, 172, and 173, continuously change capacitive reactance to inputted signals with variable charge-up and discharge times controlled by the opposing not in phase channels amplitude, phase relationships and frequencies. Higher frequencies charge and discharge capacitors 170 through 173 at a faster rate than lower frequencies. In phase inputs 106 and 107 are passed to 174 but are not summed and the frequencies in S. L. and S. R. channels (FIG. 3) are limited according to phase, frequency and amplitude differences. Input capacitor 175 provides D.C. isolation at the input of operational amplifier 178. Operational amplifier 178 with associated resistors 176 and 177 provide inverted or 180 degrees out of phase output 108. Negative feedback by resistor 176 stabilizes linearity and frequency response. Frequency response is also stabilized by the very high input impedance of amplifier 178 so the capacitive reactance of 160 and 161 will not change to effect the frequency response. Only the not in phase signals will be attenuated by their phase and amplitude relationships. The Pass And Limit Modulator 105 has passed in phase S. C. information contained in Left Input 101 and Right Input 102 into the same levels as the S. L. and S. R channels shown in FIG. 3A as Lm, Cm, and Rm. In FIG. 6A Inverter 110 inverts Operational Amplifier 178 output into 111 which is shown as a waveform 111*a* in FIG. 3A in phase with Left Input 101 and Right Input 102 shown in FIG. 3. The remaining components should not breakdown within the voltage and current limit levels allowed by the reactance of current limiting capacitors 160 and 161 which pass signals to diodes 162, 164, 166, and 168 with connections to capacitors 170, 171, 172, and 173, all which limit voltage levels to capacitor 175 at less than 2 volts P-P. Capacitor 175 value should be selected to form a low impedance connection into high input impedance amplifier 178 at all the frequencies processed, and should be a non-polarized, very low leakage type with tolerance up to + or −20%. Reverse diode semiconductor leakage should be greater than one gig-ohm at the maximum reverse biased signal applied. Other diode types can be used as long as they are low capacity and low reverse bias leakage types. Op amp input impedance should be greater than 100 gig-ohms for a good low frequency response. National Semiconductor Corporation specifies 10 terra-ohms input impedance for its LF351 operational amplifier. The inverting amplifiers 103 and 104 in FIG. 1, or FIG. 2 can be any type of amplifying semiconductor arrangement, tube type amplifiers, or step-up a. c. audio voltage transformers. Lower or higher voltage amplifiers may be used, however, most components in FIG. 1 should be modified to accommodate lower or higher voltage rating and current values. The Pass And Limit Modulator 105 uses basic components. Other combinations may be possible to attain a limited center channel output 108 or 11 by using individual circuits to mimic each function. The result would be much of more complexity and would cost much more to perform the same actions. However, it would still be repeating the basic operation using this invention as a guide.

The process for a preliminary front center channel output (Cdn) is shown in FIG. 2: The Pass And Limit Modulator 105 inverted output 108 is mixed by resistors 179, 180 and 181 in mixer 109, producing an in phase Preliminary Center Channel Output 118*a* as shown in FIG. 3B In FIG. 2 the amplitude level of 108 is adjusted to attain a minimum of Lfr and Rfr or the waveform 118 shown in FIG. 3B.

In FIG. 2A An Enhanced Front Center Channel Output 138 is obtained by applying Left Input 101 and Right Input 102 into the L-R operational amplifier 134 producing difference signal output 125. This output is inputted into Full Wave Rectifier 123 which produces a rectified difference signal 135 inputted into Filter 137 which produces Control Signal 139 inputted into VCA 124 producing a Variable Gain Control Signal 136 which is applied to Center Mixer 127. Preliminary Center Channel Output 118 is applied to Inverter 110 which inverts the Preliminary Center Channel Output 118 180 degrees which mixes in the Center Mixer 127 with the Variable Gain Control Signal 136 producing an Enhanced Center Channel Output 128 applied to the High Frequency Boost 126 producing an Enhanced Front Center Channel Output 138 by increasing high frequency signals which were minimized by up-mixing at the studio. The Enhanced Center Channel Output 128 is also inputted into the Low Pass Filter 132 producing an Enhanced Sub Woofer Output 133.

Processing into three additional channels is shown in FIG. 2A. Left and Right channel processing is as follows: Left Input 101 is applied to Left Amplifier 103 and, Right Input 102 is applied to Right Amplifier 104 which are amplified into into respective outputs 106 and 107 inputted into the Pass And Limit Modulator 105 which produces output 108. The Pass And Limit Modulator output 108 is subtracted from Left Input 101 and Right Input 102 in mixer 109 producing Preliminary Center channel Output 118. Left Input 101 and Right Input 102 are inputted into the L-R operational amplifier 134 producing difference signal output 125. This output is inputted into Full Wave Rectifier 123 producing a rectified difference signal 135 inputted into Filter 137 producing Control Signal 139 inputted into VCA 124 producing a variable gain control signal 136 which is applied to Left Mixer 140 and Right Mixer 141 to regulate the amount of preliminary center channel output 118 to subtract from Left Input 101 and Right Input 102 to obtain Left Output 142 and Right Output 146 respectively.

DETAILED APPLICATIONS DESCRIPTION

Mixed channel reproduction such as stereo utilizing two mechanical audio transducers have limited reproduction accuracy for reproducing more than one channel with each speaker. Two speakers used to simulate a front center channel or a phantom image is a poor representation to determine the origin of a sound source. The front stereo left and right speakers cannot reproduce simultaneously the front stereo center information with Stereo left and/or Stereo right channels with optimum localization or duplication qualities. This abnormality is because each forward facing front left and front right speaker moving speaker voice coil is at a different position due to varying amplitude content of the Stereo front left and Stereo front right channels. All speakers have a variable return tension depending on the position of each speaker voice coil when reproducing the mixed front center channel with other information. Therefore, when the forward facing front left or front right speaker or transducers reproduce equal volume center channel information with different volume content of Stereo front left in relation to the Stereo front right channel information, the center channel volume will not be reproduced or perceived equally in both forward facing speakers for an ideal sweet spot. This is one reason why some music does not create an ideal sweet spot. This mechanical speaker sound compression is greater at higher volume levels due to the mechanical limits of the voice coil throw. This Active Channel Crossover System, corrects this problem by minimizing the front left and front right channel information from being reproduced in the center channel output. An ideal situation is a separate center channel speaker placed the same distance from the front stereo front left and front right channel speakers facing the listener reproducing as closely as possible its original center channel content. The front center channel volume should be reduced as much as possible in both down-mixed front left and front right speakers. The front center speaker down-mix volume is adjusted to half of the stereo summed up-mix volume in phase information. The front left speaker and front right speaker volume is down-mixed to the same volume level as the stereo left and right up-mixed channels. This center channel output is further processed or reproduced into four channels including front left, front right, center, and center sub woofer. This eliminates the problem of a listener having to be positioned in the sweet spot to imagine the center channel sound. A listener positioned anywhere in front of the forward facing front speakers can definitely determine origination of each channel content. The Active Channel Crossover System containing the new art Pass And Limit Modulator down-mixes stereo information for improved reproduced sound clarity with definite channel source determination for speaker or transducer reproduction.

In an exemplary embodiment, the values of the Pass And Limit Modulator components in FIGS. 1 and 2 are as follows:

160, 161, capacitor 47 pf 500V.D.C.

170, 171, 172, 173, 175, capacitor, low leakage 0.01 uf 25V. D.C.

162, 163, 164, 165, 166, 167, 168, 169, Diode 1N4148 or low leakage diode

176, 2-22 meg-ohm ¼ watt resistors in series=44 meg-ohm

177, ¼ watt resistor 100 k-ohm

178, operational amplifier National Semiconductor LF 351 (National Semiconductor Corporation: A semiconductor manufacturer), or a very high input impedance operational amplifier;

179, 180, 181, 47 k-ohm resistors.

In FIG. 2, a typical embodiment, the values of the down-mix components, or any practical identical resistance values of 180 and 181 to attain a Preliminary Center Channel Output 118 with a wide range frequency response.

CONCLUSION, RAMIFICATIONS AND SCOPE

In the article written by Roger Dressler: Dolby Surround Pro Logic Decoder principles of operation. In section 2.7 Sensing Direction of Dominance, it quotes: "By definition, dominance can only occur in one place at any instant in time; it cannot exist in two places simultaneously, since their equality of magnitude would mean that neither is dominant". And, in section 2.5. Nature of Signal Dominance: "A dominant sound is simply that the sound that is most prominent in the mix at any given instant in time. It is necessary to be able to sense when a dominant sound occurs because it will have the greatest influence on the perception of "discreteness" or the effective separation of the soundtrack". Therefore it would seem the sooner a dominant sound is detected, and the resultant down-mix is performed and reproduced into its respective channel, the perception of the sound source would appear more apparent. Stereo is a mixed channel up-mix which mixes three channels into two outputs, so the original content cannot be reproduced simultaneously derived from that up-mix. No down-mix method can reconstruct all three up-mixed channels to their original form. This is because two channels have been combined and nothing can reconstruct the original information exactly as it was before it was up mixed. There has to be a variable transition point in the down-mix process to reconstruct the intended original information as it was in each channel during the up-mix process. If the down-mix is too slow, channel blending mixes more of the non originating channels and channel separation is poor. In order to minimize choppiness and improve separation, a variable time constant or variable must be introduced into the down-mix process. The Pass and limit Modulator does not use the conventional method of determining dominance, such as determining which of the three channel components are dominant and redirecting the dominant channels to their respective channels. It allows the passing of all in phase information while phase modulating the S. L. and S. R. channels. Preferably any S. C. channel down-mix switching must not add any frequencies other than which are present in the S. L. and S. R. channels. The Active Channel Crossover System uses the frequencies and amplitudes contained in the S. L. and S. R. channels to control the down-mix or channel separation speed. With this new art, center channel information obtained with the Active Channel Crossover System is enhanced by a ring down or frequency sensitive decomposition of stereo left and stereo right channel information contained in the down-mixed front center channel output and, with further processing, more of the S. L. and S. R. content is minimized. The advantage of this is the down-mixed left content has no additional time constants introduced to offset the perception of the sound source other than the frequency derived waveform decomposition time constants from the stereo left and right channels. This down-mix method of a frequency sensitive decomposition rate at a rate comparable to the contained frequencies minimizes adding other odd sounding passages as a result of down-mixing. Another advantage of the Active Channel Crossover System is: higher amplitude signals perform a faster down-mix, and lower amplitude signals perform a slower down-mix of the S. L. and S. R. channels. Whereas, higher levels of channel information heard determine a greater distinctness to the source of the down-mixed channel. The lesser or lower amplitude signals are not as distinct, therefore less important.

To obtain center channel sub-woofer content, direct connection with an active low pass sub-woofer amplifier to the enhanced front center channel output passes front center sub-woofer channel frequencies with less than 5% of the front left or front right channel information. Stereo left or stereo right channel information within the front channels are rejected at a time frame averaging 2 cycles per second of the left and right channels' dominant frequency. The unique feature of this process is that the center channel output is limited by waveform decay and compression of the stereo left (S. L.) and stereo right (S. R.) channels content and passing all in phase material.

The recording studio may modify the sound tracks to compensate for unpleasant sounds created in a stereo up-mix or remove higher frequency components within the center channel to prevent modulation effects with the S. L. and S. R. channels. An advantage of this new art is a capability to recover this high frequency de-emphasis with a high frequency boost into the center channel output stages.

The down converted front left, front right or front center channels share an average level of 5% of each others content. Reproducing original content as closely as possible is the intent of any mechanical audio reproduction device. Unfortunately most mechanical reproduction methods have a limited range or voice coil throw which is non linear due to the mechanical compression or limit of the voice coil as greater mechanical resistance occurs the farther it travels towards its limits. Mixed channel reproduction with conventional speakers by the new art Active Channel Crossover System signal will enhance entertainment use by minimizing this mechanical voice coil deficiency, such as reproducing two or more channels mixed with two different volume levels by separating the center channel into an individual speaker.

Examples for any stereo devices are a compact disc player, stereo signals received by an AM or FM radio, a satellite radio receiver, an internet audio processing device, record player, computer audio, any audio stereo digital player, tape player or any stereo equipment that is used for entertainment or audible value to the composer or listener. An example for any two input signals are two different sources of data with identical and mixed information, sounds from stereo music, movie tracks or multi channel sound sources.

The novel features believed characteristic of the present invention are set forth in the appended claims. It will be appreciated that various changes, modifications and additions may be made to the previously described in the embodiment within the Active Channel Crossover System without departing from the spirit and the scope of the following claims. Furthermore, the terms first and second in the description, are used for distinguishing between similar elements and not necessarily for describing a sequential or chronological order. The terms are interchangeable under appropriate circumstances.

I claim:

1. A sound processor for receiving audio input signal one and audio input signal two containing in phase content and different phase content to convert into one or more sound sources, said sound processor comprising a control circuit for passing said in phase content −3 db of its summed value and, passing said audio input signal one or said audio input signal two when one but not the other is present and, when said in-phase and said different phase content exists in said audio input signal one and said audio input signal two said in-phase content passes said −3 db of its summed value and said different phase content subtracts its content from each other, provided amplifying means provides the signals of said audio input signal one and said audio input signal two;

a cancellation means by mixing said in phase content −3 db of its summed value with said audio input signal one and said audio input signal two producing a first operational signal;

forming a difference signal between said audio input signal one and said audio input signal two producing a first difference signal;

rectifying said first difference signal producing a rectified difference signal;

a filtering means of said rectified difference signal producing a control signal;

a controlling gains means responsive to said control signal producing a second operational signal controlling the gain of the said first operational signal subtracted from said audio input signal one and said audio input signal two producing front left and front right audio outputs;

inverting said first operational signal producing an inverted first operational signal and subtracting from said second operational signal producing an enhanced center channel output;

a high frequency boost means to increasing the high frequency content of said enhanced center channel output to produce an enhanced front center channel audio output;

a low frequency boost means to increase the low frequency content of said enhanced center channel output producing a center channel sub woofer audio output.

* * * * *